US006969060B2

(12) United States Patent
Bouchal et al.

(10) Patent No.: US 6,969,060 B2
(45) Date of Patent: Nov. 29, 2005

(54) SHEET REMOVAL AND CONVEYING SYSTEM

(75) Inventors: Rob V. Bouchal, Delta (CA); Mark D. McGaire, Surrey (CA)

(73) Assignee: Creo Inc., Burnaby (CA)

( * ) Notice: Subject to any disclaimer, the term of this patent is extended or adjusted under 35 U.S.C. 154(b) by 0 days.

(21) Appl. No.: 10/716,546

(22) Filed: Nov. 20, 2003

(65) Prior Publication Data

US 2004/0113351 A1 Jun. 17, 2004

Related U.S. Application Data

(60) Provisional application No. 60/433,807, filed on Dec. 17, 2002.

(30) Foreign Application Priority Data

Dec. 16, 2002 (CA) ..... 2416366

(51) Int. Cl.[7] ..... B65H 3/14
(52) U.S. Cl. ..... 271/98; 271/106; 271/107
(58) Field of Search ..... 271/106, 107, 271/98

(56) References Cited

U.S. PATENT DOCUMENTS

| | | | | |
|---|---|---|---|---|
| 3,039,767 | A * | 6/1962 | Staines | 271/103 |
| 4,403,030 | A * | 9/1983 | Miura et al. | 430/273.1 |
| 4,518,159 | A * | 5/1985 | Nishibori et al. | 271/103 |
| 4,568,073 | A * | 2/1986 | VanHorne | 271/11 |
| 4,968,019 | A * | 11/1990 | Tanabe et al. | 271/106 |
| 5,350,166 | A * | 9/1994 | Shimizu et al. | 271/14 |
| 5,967,508 | A * | 10/1999 | Olexy | 271/106 |
| 6,431,539 | B2 * | 8/2002 | Laroche | 271/106 |
| 6,607,192 | B2 * | 8/2003 | Ono et al. | 271/90 |
| 6,675,712 | B2 * | 1/2004 | Marincic et al. | 101/477 |
| 6,688,591 | B2 * | 2/2004 | Larsen et al. | 271/98 |
| 6,776,097 | B2 * | 8/2004 | Takeda | 101/477 |

* cited by examiner

*Primary Examiner*—David H. Bollinger
(74) *Attorney, Agent, or Firm*—Oyen Wiggs Green & Mutala LLP

(57) ABSTRACT

In a device for handling sheets of media in a stack, a picker bar for engaging the edge of a media sheet covers only a portion of the width of the sheet. The picker bar is rotated to shape the edge into a curve thus stiffening the edge so that it may be removed from the stack. The sheet, so engaged, may be conveyed or disposed of as required.

6 Claims, 5 Drawing Sheets

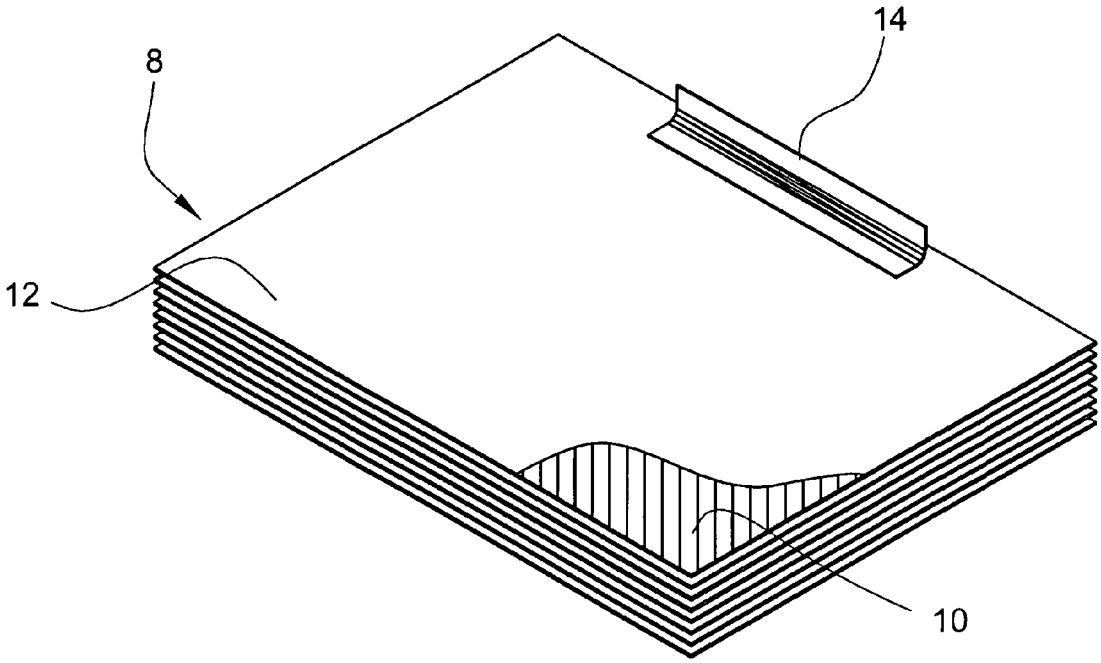
FIG. 1-A
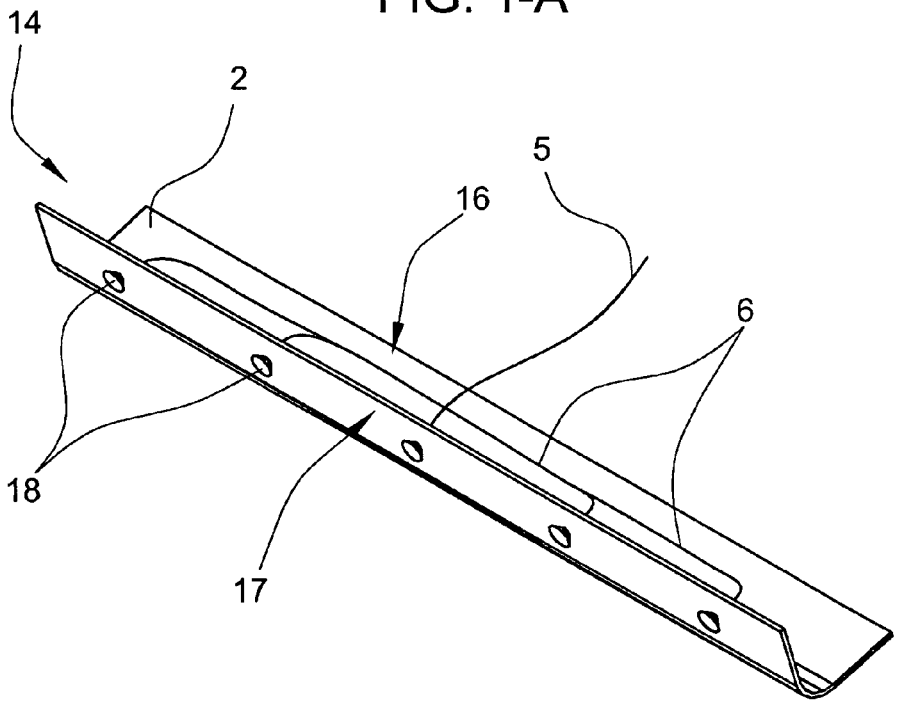
FIG. 1-B

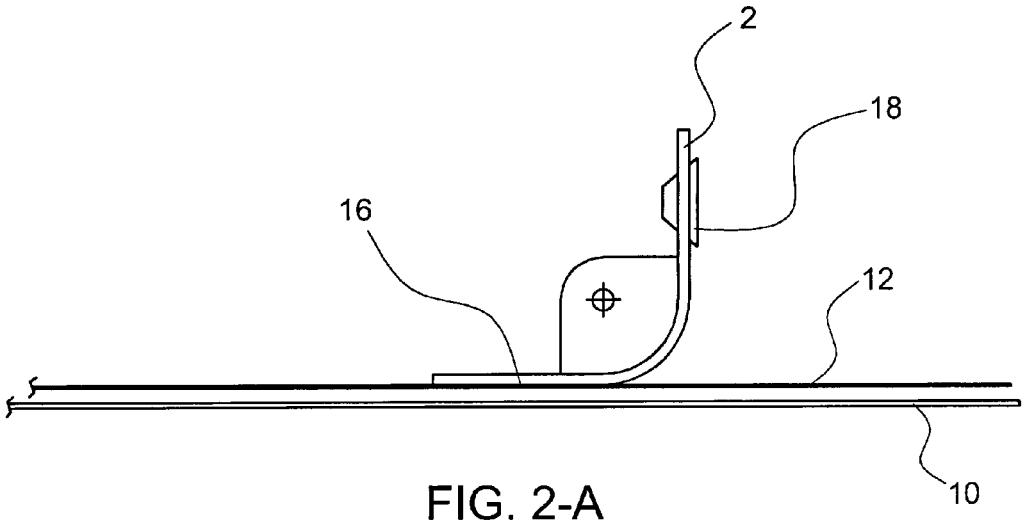
FIG. 2-A
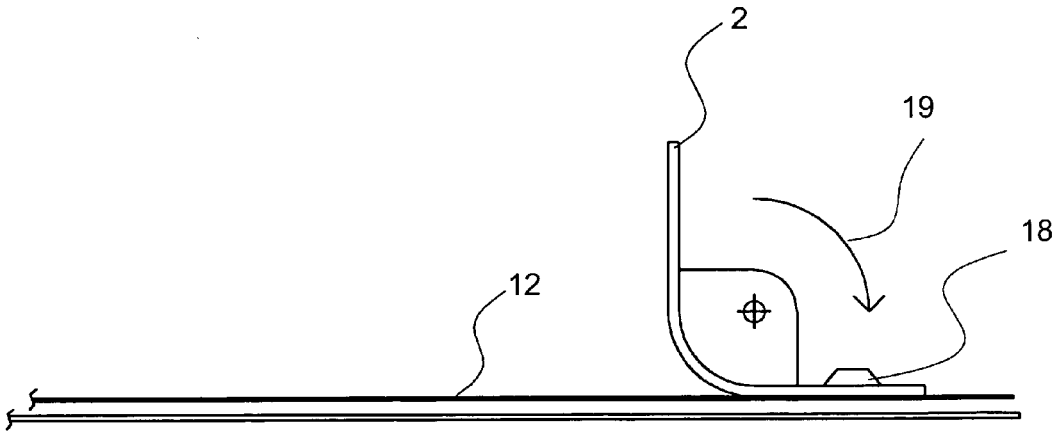
FIG. 2-B

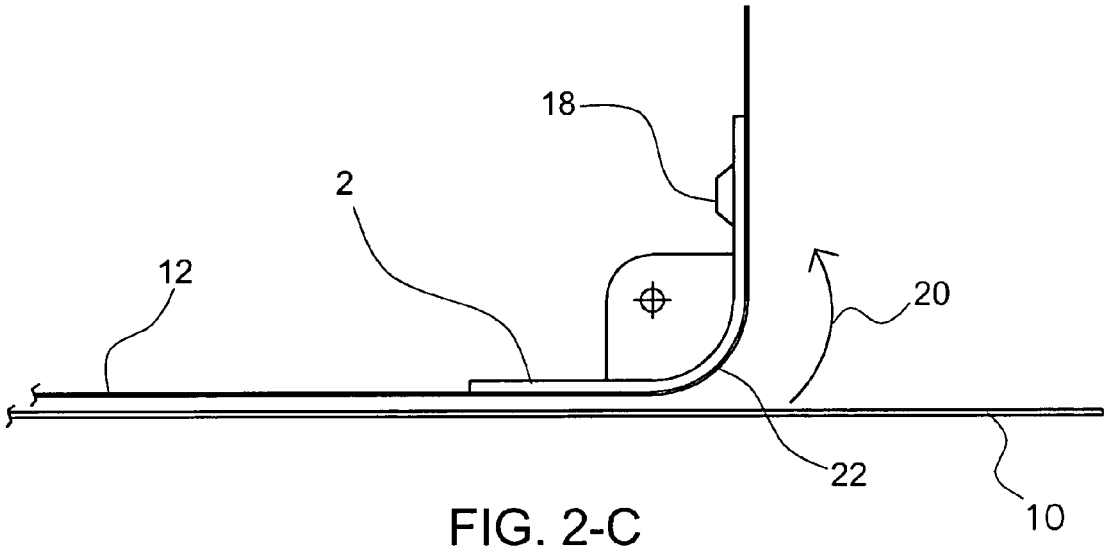
FIG. 2-C
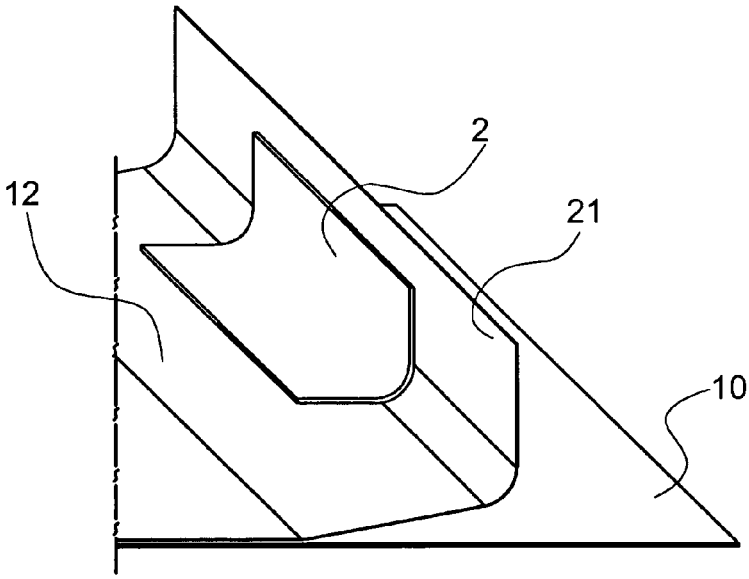
FIG. 2-D

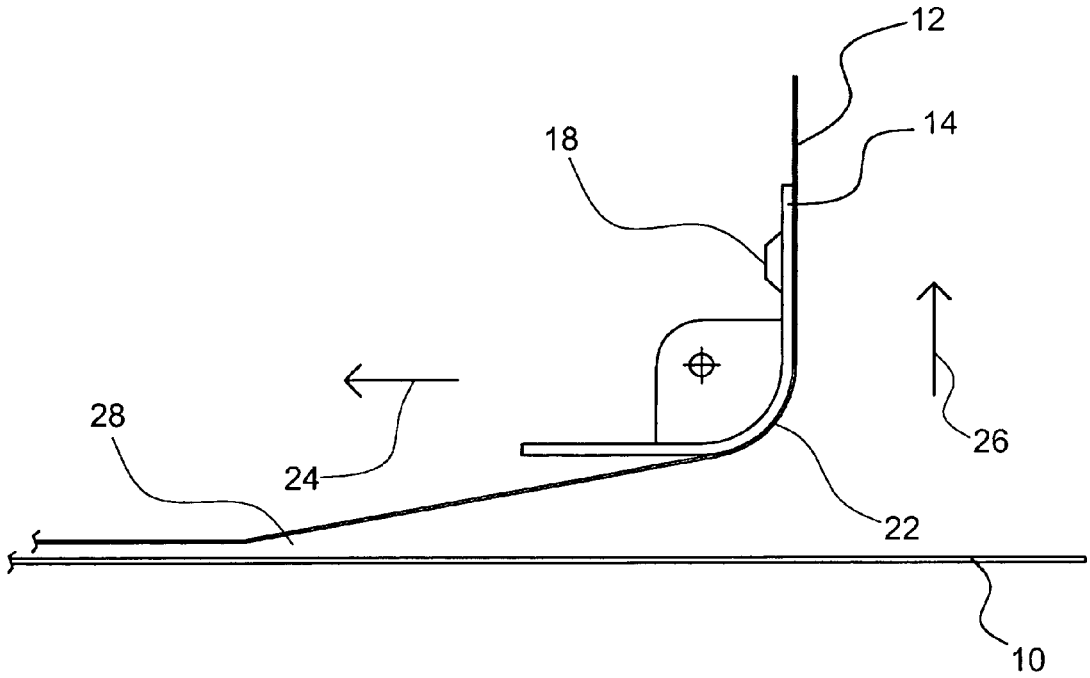
FIG. 2-E

SHEET REMOVAL AND CONVEYING SYSTEM

RELATED APPLICATIONS

This application claims benefit of the filing date of Canadian Application 2416366 filed on Dec. 16, 2002. This application also claims benefit of the filing date of U.S. Application 60/433,807 provisionally filed on Dec. 17, 2002.

TECHNICAL FIELD

The invention relates to systems for handling flat sheets of media and more particularly to a system for holding and conveying a sheet from a stack of sheets.

BACKGROUND

Plates, films and proofing media for imaging systems, such as those used in the graphic arts industry, are commonly stacked in boxes with slip-sheet sheets interspersed between adjacent media sheets. The slip-sheet primarily functions to protect the media surface from damage and to prevent adjacent media sheets from adhering to each other. The slip-sheet is particularly important when the active emulsion of the media is either sticky or particularly sensitive to damage.

In the development of media for imaging tasks, particularly plates for lithographic printing operations, a number of often conflicting parameters such a print run length, exposure sensitivity, exposure latitude and processing requirements must often be traded off against one another to achieve best results. Some media have particularly good performance in relation to the abovementioned parameters but suffer from extreme delicacy of the un-exposed media emulsion. In a specific case, LH-PI lithographic plates supplied by Fuji Photo Film Co. Ltd. of Tokyo, Japan, have a particularly delicate emulsion and may be scratched even by the action of removing the slip-sheet. However, once exposed, the emulsion is durable and the plate images well and has good on-press performance.

Other commonly available media may have similar problems with delicate emulsion surfaces although, depending on the thickness and particular characteristics of the emulsion, scratches may or may not remain visible after subsequent processing. While not all media require special attention be paid to how slip-sheets are removed the problem has been evident in a number of media products in the graphic arts industry.

In U.S. Pat. No. 5,655,452 to Blake et. al. a slip-sheet removal mechanism for removing a slip-sheet from a plate is described. Briefly, the removal operates by activating a peeler airflow to initiate separation between the slip-sheet and the plate. A number of suction tubes are pivoted into a location above the slip-sheet and the stack of plates is moved to bring the slip-sheet into engagement with the suction cups. A combination of movement of the plate stack and pivoting of the suction cups is used to separate the slip-sheet and move it towards a pair of nip rollers that complete the removal operation.

There remains a need for better methods of handling slip-sheets and there is a particular need for such a slip-sheet removal mechanism that performs the removal without any damage to the media emulsion.

SUMMARY OF THE INVENTION

In a first aspect of the present invention a method of removing a sheet from a stack of sheets involves engaging an edge of the sheet along only a portion thereof and then shaping the edge of the sheet to increase its stiffness whereafter the shaped edge is displaced relative to the stack to remove the sheet.

In another aspect of the present invention an apparatus for removing a sheet from a stack of sheets comprises a moveable picker bar extending over a portion of the width of the sheet. The picker bar has at least one engagement structure for engaging the sheet near an edge and shaping the edge to increase its stiffness.

In yet another aspect of the present invention an apparatus for removing a sheet from a stack comprises means for engaging an edge of the sheet, means for shaping the edge of the sheet such that the edge is stiffened and means for displacing the shaped edge to remove the sheet from the stack.

For an understanding of the invention, reference will now be made by way of example to a following detailed description in conjunction with accompanying drawings.

BRIEF DESCRIPTION OF THE DRAWINGS

In drawings which illustrate by way of example only preferred embodiments of the invention;

FIG. 1-A is an isometric view a stack of media and a picker bar;

FIG. 1-B is an enlarged isometric view of the picker bar shown in FIG. 1-A;

FIG. 2-A to 2-E depict a series of steps in removing a slip-sheet using the picker bar of the present invention;

DESCRIPTION

Figure 3:
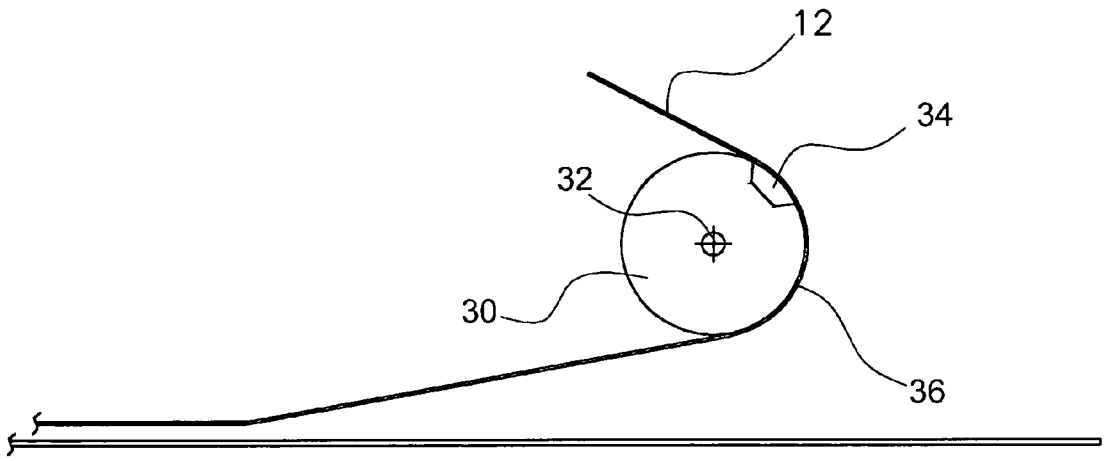
FIG. 3 is a side view of an alternate embodiment of the invention.

The invention is described in relation to a novel slip-sheet removal system that is able to remove a slip-sheet from a media without damaging the delicate emulsion. The method of slip-sheet removal specifically avoids causing any relative movement between the slip-sheet and the media emulsion. While of particular application in removing slip-sheet from a stack of media in a graphic arts imaging system, the method and apparatus of the present invention may be useful in handling other types of media particularly where the media is delicate and susceptible to damage. The term "media" should be read to include all manner of media used in imaging and printing operations including, but not limited to, plates, films, paper and coated paper.

In a particular application, lithographic plates are often shipped in boxes of 25 or more plates with thin paper slip-sheets interspersed between plates. In an automatic plate handling system the stack of plates are commonly placed in an access position from which they are loaded onto the imaging engine by some manner of automated handler. The slip-sheets represent a problem for automatic media handling in that they must be removed prior to imaging. The removal is often complicated by electrostatic attraction between the sheet and the media surfaces. Because the slip-sheet is in intimate contact with the surface of the media a removal mechanism should also allow for the ingress of air under the slip-sheet as it is removed. The slip-sheet removal mechanism has the task of reliably separating the sheet from the plate and removing it to a location where it can be disposed of. It has been observed by the inventors of the present invention that emulsion damage may occur during slip-sheet removal whenever the edges are dragged or the material is bunched up and/or creased. During the slip-sheet removal process, the shearing action between the slip-sheet and the plate becomes localized to these creased areas and scuffing or scratching may occur. Further, it has been determined that if the slip-sheet can be engaged without forming creases so that it remains flat, and the engaged sheet can be lifted away from the media in substantially this condition, scuffing may be completely avoided.

One possible solution is to engage the edge of the slip-sheet with an extended picker bar, either with a plurality of suction cups or a vacuum groove distributed over substantially the entire length of the sheet. While this solution has been found to work adequately there are some problems. Firstly, imaging systems typically accommodate a wide variety of media sizes and the bar would have to cover the full width of the largest media used. For smaller media sizes the bar overlaps the edges causing problems with vacuum escapement in places where there is no slip-sheet material to engage. This problem can be addressed by providing zoned vacuum delivery albeit at higher cost and complexity. Secondly, the length of the bar for Very Large Format (VLF) size imaging devices becomes almost unmanageable and overly expensive since it must be made sufficiently rigid so as not to deform during actuation.

An embodiment of the present invention is shown in FIG. 1-A. A media stack 8 with slip-sheets interspersed is shown in an access position. For sake of clarity the autoloder device is not shown except for the slip-sheet removal components. The top media sheet 10 (shown in cutaway view) in the stack 8 is covered by a slip-sheet 12. A picker bar 14 is shown in position to engage the slip-sheet 12 at one edge. While in an automatic system the stack may comprise a plurality of media sheets, a manually loaded system may only have one media sheet in the access position.

The picker bar 14, shown in more detail in FIG. 1-B, comprises a rigid angled frame 2 comprising an engaging face 17 and a heel portion 16. The frame 2 has a plurality of compliant suction cups 18 on a slip-sheet engaging face 17. Vacuum is supplied to the suction cups 18 via a number of vacuum lines 6 attached to a common supply line 5. To grasp a slip-sheet suction cups 18 are brought into engagement with a slip-sheet and a vacuum is applied to line 5. Advantageously a plurality of small diameter suction cups are used which reduces the possibility of the slip-sheet being deformed under the cups and thus forming creases that may scuff the emulsion. It was experimentally determined that suction cups purchased from Anver Corp of Hudson Mass., model PFA7 part number 21700004, with a face diameter of around 7 mm worked particularly well. Suction cups 18 may be made from a compliant material or simply suction holes formed directly in the frame. The vacuum may be applied directly or indirectly by using a Bernoulli effect device (the Bernoulli effect may be exploited to apply a holding force to a sheet by passing a stream of air over the sheet surface or an aperture). Alternatively the suction cups may be substituted by a variety of other engagement structures. For example, a longitudinal vacuum groove may be formed in the face 17 frame 2 to distribute the vacuum over a larger area. Mechanical fingers may also be used to pick and hold the slip-sheet, but for extremely delicate media there will be a higher risk of scuffing the emulsion.

As can be seen in FIG. 1-A the picker bar only engages the central area of one edge of the slip-sheet. The method of operation of the picker bar will be further explained with reference to FIG. 2A-2E. For sake of clarity the actuator mechanisms for moving the bar towards the slip-sheet and for rotating it into engagement with the slip-sheet are not shown in the drawing figures since such mechanisms are well known in the art. Referring now to FIG. 2-A, initial engagement with the slip-sheet is with the heel 16 of the picker bar. At this stage, the suction cups 18 are still oriented away from slip-sheet 12. It may be necessary to add a compliant padding to the heel 16 to ensure that it does not scuff the plate 10 through slip-sheet 12. The rear of the heel may also be curved to reduce scuffing, and the padding may extend around the curved portions of frame 14 as well. In the drawing figures, the gap between the slip-sheet 12 and the media 10 is exaggerated for clarity but in reality, the slip-sheet 12 rests on the plate surface.

In FIG. 2-B the suction cups 18 on frame 2 are rotated in a direction shown by arrow 19 into engagement with slip-sheet 12 whereafter a vacuum is applied to grasp the slip-sheet. The vacuum may be generated using any known convenient means and may be applied by electrically activating a vacuum source or by opening a electromechanical valve or a combination of both. The vacuum may be applied before the suction cups engage the slip-sheet but it is preferred to apply it after the cups are in contact with the slipsheet. Referring now to FIG. 2-C, once the slip-sheet 12 is held by the suction cups 18 the frame 2 is rotated back in the direction shown by arrow 20. This rotation causes the slip-sheet to lift off the plate 10 while simultaneously curling the edge 22 of slip-sheet 12. The curling of the slip-sheet edge 22 (best shown in FIG. 2-D), offers a substantive advantage over simply lifting the slip-sheet 12 directly off the plate. Firstly, any attempt to lift the slip-sheet directly from the position shown in FIG. 2-B will likely cause the sheet to bunch and crease when the portion held by the picker bar 14 is pulled. The outer edges (shown at 21 in FIG. 2-D) may still adhere to the media 10 until the electrostatic forces are broken and air ingress releases the slip-sheet. Under these conditions, creases may form and the media emulsion may be scuffed. Secondly, the force needed to peel the slip-sheet away in a curling motion is less than that required for direct lifting. In essence, introducing the curl compensates for the fact that frame 2 does not extend over the entire width of the slip-sheet 12 by forming a curled edge 22. Curled edge 22 is more rigid than an uncurled edge and also provides region along which the attractive forces are at least partially reduced thus facilitating further partial or complete peeling without introducing creasing or bunching. The amount of curl may be 90° as shown or greater; larger curl typically providing a progressively stiffer edge. On the other hand, a curl of less than 90° may also be acceptable depending on the width and material of the slip-sheet and the media.

Once the curled edge is formed, the slip-sheet may be peeled off the plate by one of, or a combination of movements in the directions shown by arrows 24 and 26 as shown in FIG. 2-E. The curled edge 22 prevents the outer edges (shown at 21 in FIG. 2-D) from falling back and scuffing the media emulsion. As the slip-sheet 12 is peeled back, an separation region 28 continues to propagate allowing the electrostatic and other forces to be broken along the width of the slip-sheet. The slip-sheet is thus at least partially removed and may be passed on to a disposal mechanism such as the slip-sheet compactor described in commonly assigned U.S. patent application Ser. No. 10/612,918 by Williams and incorporated herein by reference. Alternatively, the sheet may be slid off the stack in a direction opposite to indicated direction 24. In this case the curl in the edge prevents creasing or bunching allowing the sheet to be slid from the stack.

The present invention is not limited to handling slip-sheet material but may also be employed to handle any flimsy media using a picker bar that is shorter than the width of the media. In particular, graphic arts film and colour proofing media commonly comprise an emulsion on a thin sheet of polyester that may suffer either emulsion damage or creasing during handling. The loading of a flimsy media that has delicate emulsion may prohibit engaging the emulsion side or sliding the emulsion over the back of another sheet. The picker bar may engage the rear surface of the sheet and peel it back so that there is substantially less slippage between adjacent sheets. The picker bar may be used in a fully automatic system where the sheet is picked from a plurality of sheets in a stack or it may be used in a semi-automatic system where a single sheet is placed in an access position prior to being automatically loaded into the imaging device. Likewise, the same picker bar may be used to convey the sheet from the imaging device on completion of imaging.

In an alternative embodiment, the picker bar may be constructed using a circular bar 30 shown in FIG. 3. Circular picker bar 30 is rotatably supported at axis 32 and has a recessed suction cup 34. Circular picker bar 30 grasps the slipsheet via suction cups 34 and rotates to form a partially tubular curled edge 36. Advantageously the tubular curled edge 36 has better stiffness than the previously describe curled edge. Furthermore the circular section bar may be made from common bar or tube stock whereas the angled bar shown in the drawing figures may have to be custom fabricated.

Actuators suitable for placing the picker bar on the sheet and rotating to engage the suction cups are well known. Pneumatic actuators, motors, stepper motors or servomotors may be used. Typically, the actuation functions required include a translation to place the picker bar on the slip-sheet and an actuation to rotate the bar into engagement. The rotation may be supplied by a separate actuator or the bar may simply be allowed to roll to bring the suction cups into engagement. The rotation of the picker bar may also be synchronized to the forward and backward movement of the picker bar to eliminate the possibility of the slip-sheet being slid forward over the media emulsion when the bar is rotated to engage the suction cups. If the shearing friction between the slip-sheet and the media emulsion is low, this may be addressed by actively rotating the picker bar when engaging the suction cups rather than just allowing it to roll forward. On the other hand, if the shearing friction is high enough and the slip-sheet does not slide easily the separate actuator may be eliminated. Alternatively, the bar & suction cups may be lowered directly into engagement without the requirement of a further rotation.

Figure 4:
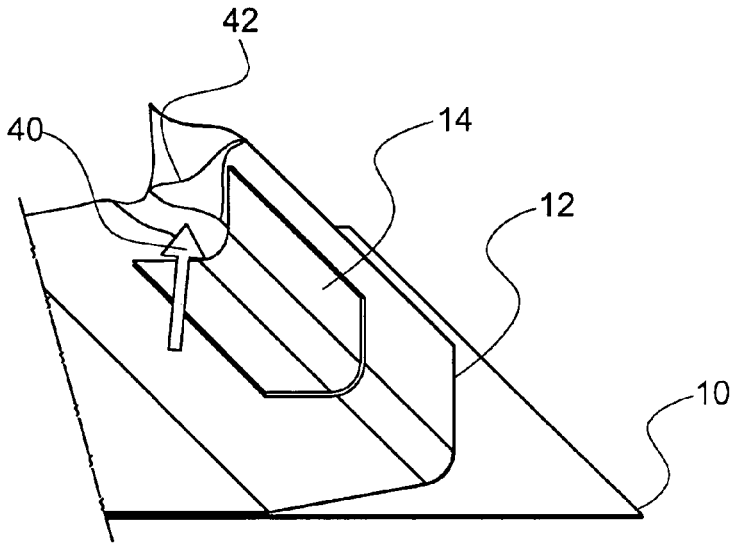
FIG. 4 is a perspective view of another embodiment of the invention.

In another embodiment shown in FIG. 4, one or more jets of air 40 may be provided to assist in introducing the curl. In the event of a kink 42 forming in the edge of the slip-sheet the jet of air 40 may be blown along the slip-sheet 12 to snap the edge into the desired shape. The direction of the air jet 40 is only one example of many possibilities, including multiple air jet directions at the same time, or sequenced air jets. Air jet 40 may be mounted on picker bar 14 or may be separately mounted.

Once the curl is formed in the edge of the sheet and a propagating edge is established (as described in relation to item 28 of FIG. 2-E), the sheet may be removed in either direction. The sheet may be folded over itself and removed in a direction towards the opposite edge of the stack from the edge that was engaged. Alternatively, the sheet may be slid off in a direction away from the stack, lead by the curled edge.

While the shape for stiffening the front edge of the slip-sheet has been described as a "curl" in this description, it may be any of a variety of shapes including but not limited to a "V" shape or a sine wave shape. Furthermore, the shape may or may not include a creasing of the edge to increase stiffness. Such creasing would not be a problem to a delicate emulsion if performed once the slip-sheet is lifted away from the media. The curl described herein has the advantage of being easy to create and has a low chance of scuffing the media. Accordingly, the term "curl" is used herein to describe any shape that is given to the edge of the slip-sheet or media with the intent of stiffening.

As will be apparent to those skilled in the art in the light of the foregoing disclosure, many alterations and modifications are possible in the practice of this invention without departing from the spirit or scope thereof.

What is claimed is:

1. A method of removing a sheet from a stack of sheets, the method comprising:

engaging an edge of the sheet along a portion thereof with a picker bar comprising a sheet engagement structure adjacent an elongated heel portion;

shaping the edge of the sheet by rotating the picker bar by at least about 90 degrees to bend the sheet around the heel portion while maintaining engagement of the edge of the sheet by the sheet engagement structure; and displacing the shaped edge relative to the stack to remove the sheet.

2. A method according to claim 1, wherein engaging the sheet along a portion thereof comprises engaging the sheet over a centrally located portion thereof.

3. A method according to claim 1, wherein shaping the edge comprises forming a generally right angled curl in the edge of the sheet.

4. A method according to claim 1, wherein shaping the edge comprises forming a partially tubular curl in the edge of the sheet.

5. A method according to claim 1, wherein removing the sheet comprises displacing the shaped edge with a movement that carries the shaped edge over the stack in a direction toward an edge of the sheet opposed to the shaped edge such that the sheet at least partially folds back on itself.

6. A method according to claim 1, further comprising transferring the sheet to a sheet compactor.

* * * * *